US007528783B2

(12) United States Patent
Takagi

(10) Patent No.: US 7,528,783 B2
(45) Date of Patent: May 5, 2009

(54) ANTENNA

(75) Inventor: Naoyuki Takagi, Shiga (JP)

(73) Assignee: Panasonic Corporation, Osaka (JP)

( * ) Notice: Subject to any disclaimer, the term of this patent is extended or adjusted under 35 U.S.C. 154(b) by 25 days.

(21) Appl. No.: 11/954,916

(22) Filed: Dec. 12, 2007

(65) Prior Publication Data

US 2008/0169984 A1 Jul. 17, 2008

(30) Foreign Application Priority Data

Jan. 15, 2007 (JP) ..... 2007-005620

(51) Int. Cl.
*H01Q 1/24* (2006.01)

(52) U.S. Cl. ..... 343/702; 343/833; 343/834

(58) Field of Classification Search ..... 343/702, 343/833, 834, 700 MS, 850, 893, 725, 729
See application file for complete search history.

(56) References Cited

U.S. PATENT DOCUMENTS 6,429,818 B1 * 8/2002 Johnson et al. ..... 343/702
6,456,249 B1 * 9/2002 Johnson et al. ..... 343/702
7,319,432 B2 * 1/2008 Andersson ..... 343/702
7,420,513 B2 * 9/2008 Tsutsumi et al. ..... 343/700 MS
2002/0070902 A1 * 6/2002 Johnson et al. ..... 343/702
2004/0248523 A1 * 12/2004 Nishimura et al. ..... 455/78
2006/0033667 A1 * 2/2006 Johnson ..... 343/702

FOREIGN PATENT DOCUMENTS

JP 2005-295002 10/2005

* cited by examiner

*Primary Examiner*—HoangAnh T Le
(74) *Attorney, Agent, or Firm*—McDermott Will & Emery LLP

(57) ABSTRACT

An antenna including a rectangular ground plane, a feed point disposed in a vicinity of a corner of the ground plane, an antenna element coupled to the feed point, and a parasitic element coupled to the ground plane. In this antenna, the shortest length from the feed point to a distant narrow side of the ground plane and a shortest length from the feed point to a tip of the parasitic element via the ground plane have substantially the same electrical length. Such a configuration can correspond to a small and thin size and reduce SAR easily.

4 Claims, 5 Drawing Sheets

ANTENNA

BACKGROUND OF THE INVENTION

1. Field of the Invention

The present invention relates to an antenna mainly used in a wireless device for mobile communication and the like.

2. Background Art

Recently, demand for wireless devices for mobile communication such as a portable telephone has increased rapidly. An antenna mounted on a wireless device is one of the important devices affecting the performance of the wireless device. Antennas have been required to be small and thin in size and have a reduced effect on a human.

Herein, such a conventional antenna mounted on a portable telephone as a wireless device is described with reference to a drawing.

FIG. 5 is a schematic view showing a conventional antenna mounted on a portable telephone. In FIG. 5, conventional antenna 6 includes rectangular ground plane 3, feed point 4 disposed in the vicinity of a corner of ground plane 3, antenna element 1 coupled to feed point 4, variable reactance element 5 disposed on ground plane 3, and parasitic element 2 coupled to variable reactance element 5.

The above-mentioned conventional antenna 6 switches values of variable reactance element 5 by using a switching processing circuit and the like, between a value of variable reactance element 5 showing omnidirectional radiation characteristics during a standby time and a value of variable reactance element 5 showing directional radiation characteristics by coupling antenna element 1 and parasitic element 2 to each other so that the radiation of electric waves to the side of a human is reduced during a talk time.

As mentioned above, the conventional antenna 6 changes the radiation characteristics of antenna 6 between during a standby time and during a talk time by changing the value of variable reactance element 5. Thus, an excellent radiation characteristic is kept in each state. An example of prior art information related to the invention of this application includes Japanese Patent Application Unexamined Publication No. 2005-295002.

In the conventional antenna 6, by changing the value of variable reactance element 5 during a talk time, antenna element 1 and parasitic element 2 are coupled to each other so as to strengthen the directivity of antenna 6, thereby reducing the radiation of electric waves to the human side that is brought to the ear during a talk time. As a result, it is possible to reduce SAR (Specific Absorption Rate) that is an index showing the degree of the effect of electromagnetic wave on the human.

However, in order to reduce SAR, it is necessary to change values of variable reactance element 5 between a standby time and a talk time. Therefore, it is necessary to add a switching processing circuit and the like.

SUMMARY OF THE INVENTION

The present invention provides an antenna having a configuration in which a variable reactance element is not used and the adjustment thereof is not required and which is capable of corresponding to a small and thin size of a wireless device and reduces SAR as an index showing the degree of the effect of electromagnetic waves on a human.

The antenna of the present invention includes a substantially rectangular ground plane, a feed point disposed in the vicinity of a corner of this ground plane, an antenna element coupled to this feed point, and a parasitic element coupled to the ground plane. In this antenna, the shortest length from the feed point to a distant narrow side of the ground plane and the shortest length from the feed point to a tip of the parasitic element via the ground plane have substantially the same electrical length. Since a route from the feed point to the distant narrow side of the ground plane and a route from the feed point to the tip of the parasitic element via the ground plane have the same length, a high-frequency current mainly excited on the ground plane is distributed into two directions. As a result, the peak value of the high-frequency current mainly excited on the ground plane is lowered, and SAR can be reduced. Therefore, since a variable reactance element is not used, it is possible to provide an antenna capable of corresponding to a small and thin size and reducing SAR easily.

DETAILED DESCRIPTION OF THE INVENTION

First Embodiment

Figure 1:
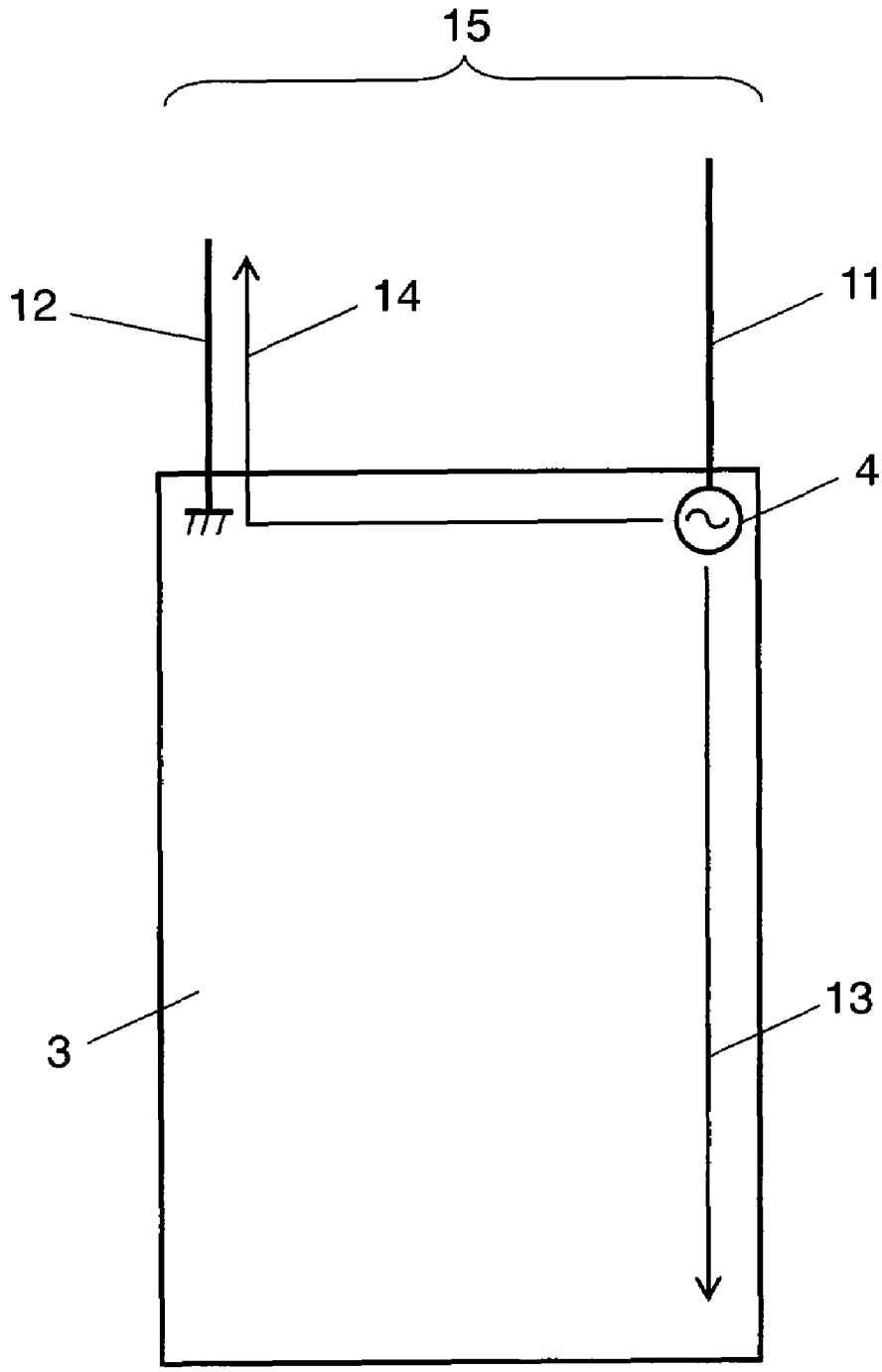
FIG. 1 is a schematic view showing an antenna in accordance with a first embodiment of the present invention.

Hereinafter, the embodiment of the present invention is described with reference to drawings. Note here that the same reference numerals are given to portions of the same configuration described in the conventional technology and the detailed description thereof is omitted herein.

FIG. 1 is a schematic view showing an antenna in accordance with a first embodiment of the present invention. In FIG. 1, antenna 15 includes substantially rectangular ground plane 3, feed point 4 disposed in the vicinity of a corner of ground plane 3, antenna element 11 coupled to feed point 4, and parasitic element 12 coupled to ground plane 3. The length of parasitic element 12 is adjusted and coupled so that the shortest length from feed point 4 to a distant narrow side of ground plane 3 and the shortest length from feed point 4 to a tip of parasitic element 12 via ground plane 3 have substantially the same electrical length.

Herein, an operation state of antenna 15 is described. When antenna 15 is operated, with the excitation by antenna element 11 and ground plane 3, a high-frequency current flows in ground plane 3. At this time, in antenna 15 in accordance with the first embodiment, high-frequency current 13 excited in the direction from feed point 4 to the distant narrow side of ground plane 3 and high-frequency current 14 excited from feeding point 4 to parasitic element 12 via ground plane 3 have substantially the same electrical length. Consequently, a main high-frequency current excited on ground plane 3 is distributed into two directions.

In this way, since the main high-frequency current excited on ground plane 3 is distributed into two directions, the peak value of the high-frequency current excited on ground plane 3 is lowered, so that SAR can be reduced.

Therefore, unlike a conventional technology, since antenna 15 does not need to use a variable reactance element, it is possible to realize an antenna that can correspond to small and thin size of equipment and can reduce SAR easily.

Figure 2:
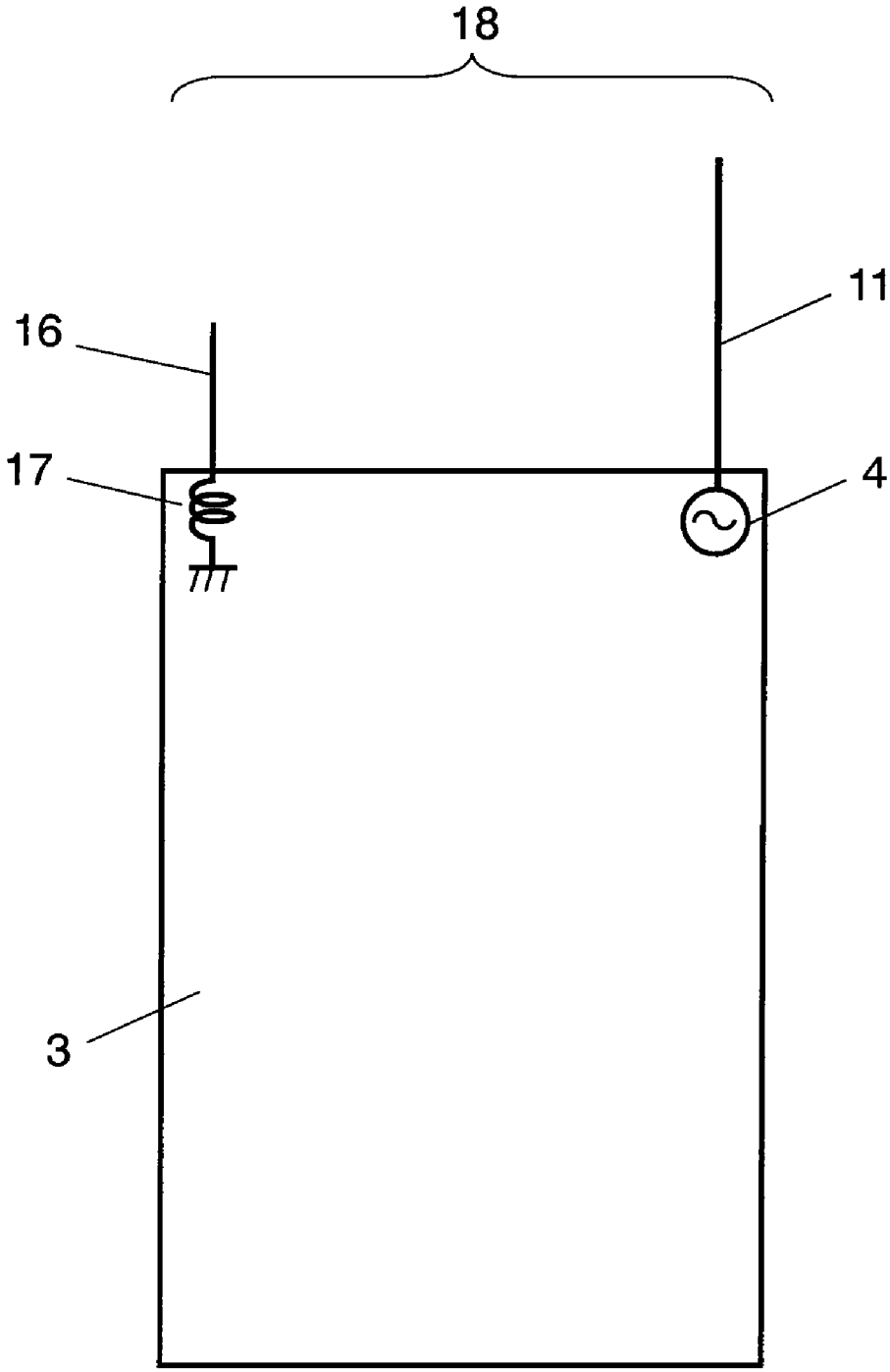
FIG. 2 is a schematic view showing a configuration in which an inductor is disposed between a parasitic element and a ground plane of an antenna in accordance with the first embodiment of the present invention.

FIG. 2 is a schematic view showing a configuration in which an inductor is disposed between a parasitic element and a ground plane of an antenna in accordance with the first embodiment of the present invention. As shown in FIG. 2, inductor 17 may be disposed between ground plane 3 and parasitic element 16. With such a configuration, an apparent high-frequency electrical length is increased by inductor 17. Therefore, even when parasitic element 16 is made to be shorter, the distance of the route from feed point 4 to a tip of parasitic element 16 via ground plane 3 can be electrically equalized to the direct distance from feed point 4 to the distant narrow side of ground plane 3. Thus, antenna 18 can be miniaturized. In this configuration, inductor 17 is disposed on ground plane 3. However, the similar effect can be obtained when inductor 17 is disposed in the middle of parasitic element 16 or at the tip of parasitic element 16.

Figure 3:
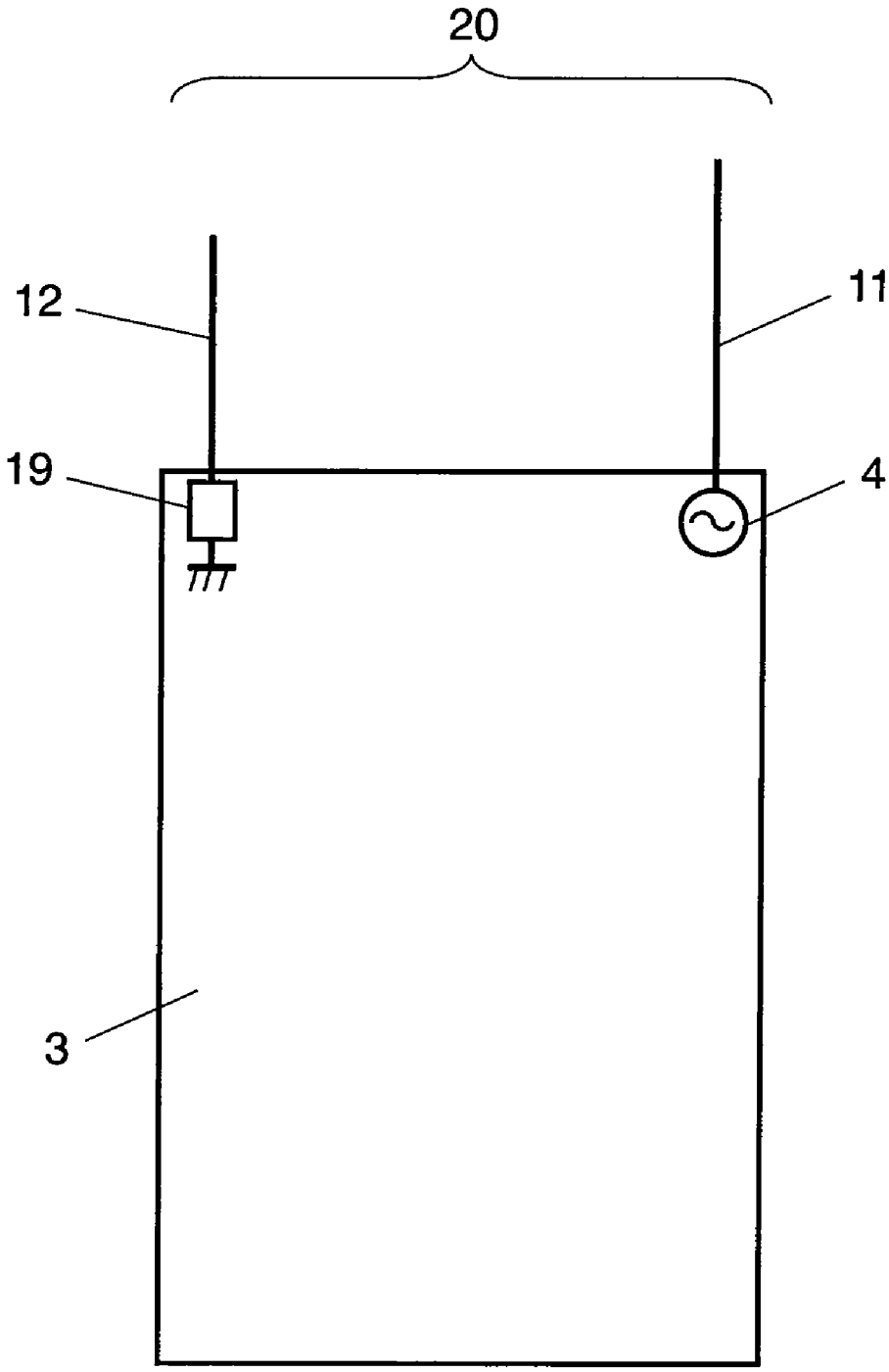
FIG. 3 is a schematic view showing a configuration in which a switch is disposed between a parasitic element and a ground plane of an antenna in accordance with the first embodiment of the present invention.

FIG. 3 is a schematic view showing a configuration in which a switch is disposed between a parasitic element and a ground plane of an antenna in accordance with the first embodiment of the present invention. In FIG. 3, switch 19 is disposed on ground plane 3 coupled to parasitic element 12. With such a layout, when switch 19 is turned off, a high-frequency current excited on ground plane 3 is one. When switch 19 is turned on, a high-frequency current excited on ground plane 3 is distributed because a high-frequency current flowing from ground plane 3 to parasitic element 12 is added. That is to say, since the high-frequency current excited on ground plane 3 can be changed by switch 19, not only reduction of SAR but also control of the directivity can be realized.

Figure 4:
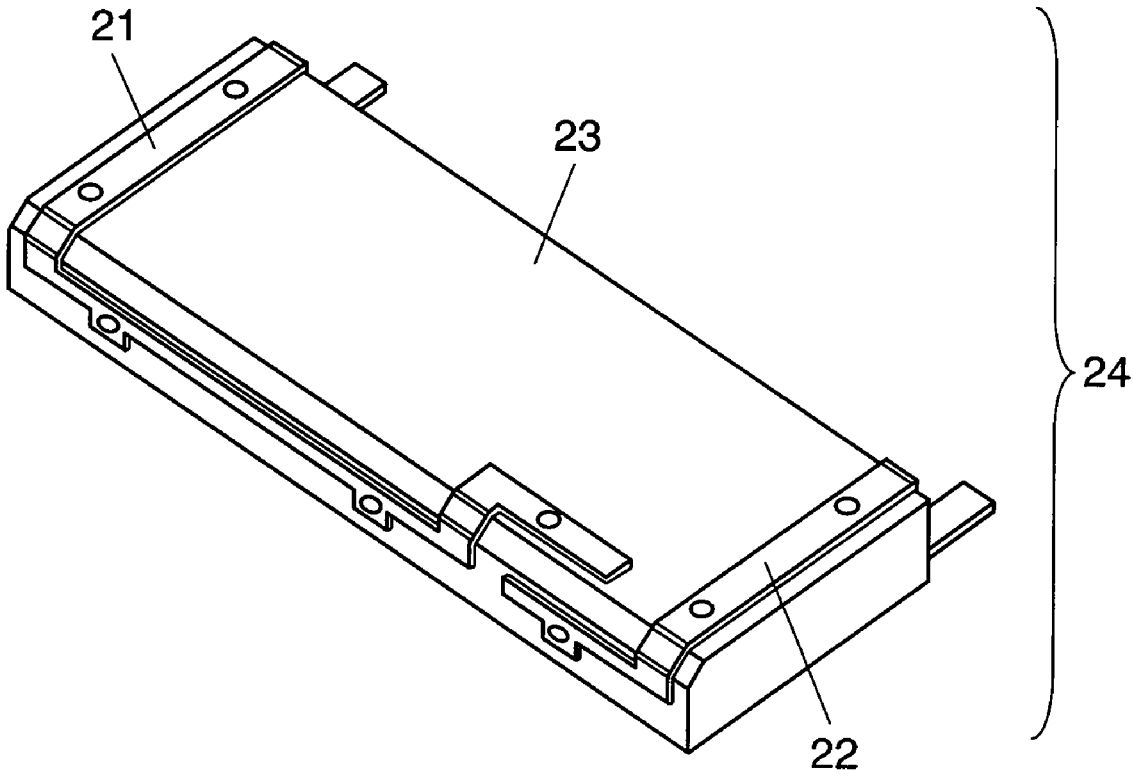
FIG. 4 is a perspective view showing an antenna in which an antenna element and a parasitic element are held on a holding portion made of insulating resin in accordance with the first embodiment of the present invention.
Figure 5:
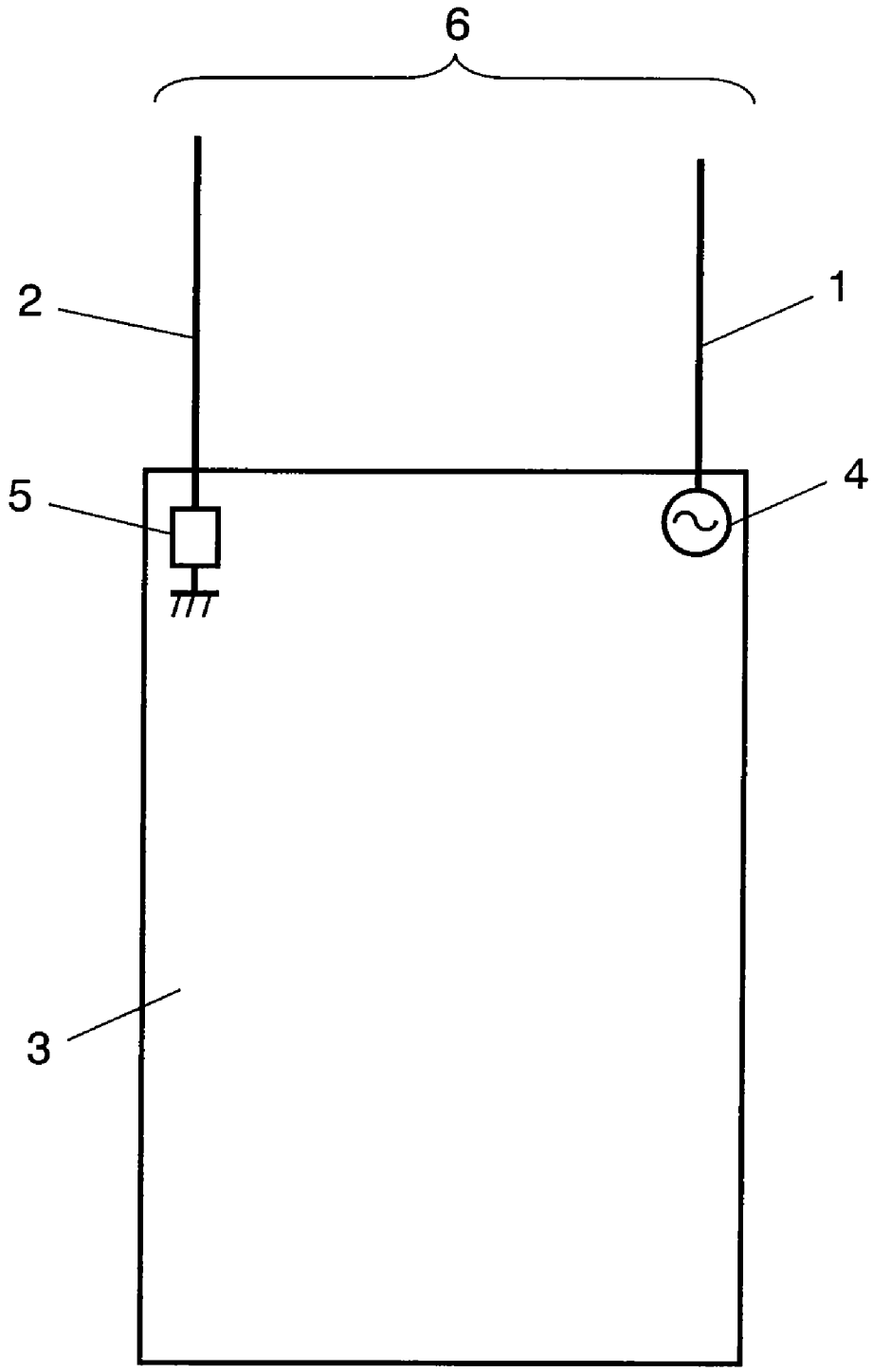
FIG. 5 PRIOR ART
FIG. 5 is a schematic view showing a conventional antenna.

FIG. 4 is a perspective view showing an antenna in which an antenna element and a parasitic element are held on a holding portion made of insulating resin in accordance with the first embodiment of the present invention. In FIG. 4, caulking protrusions are provided on the surface of holding portion 23 made of insulating resin and the caulking protrusions are crushed and caulked. With such a configuration, antenna element 21 and parasitic element 22 corresponding to the above-mentioned antenna element 11 and parasitic element 12 can be attached and held on holding portion 23. Therefore, antenna 24 can be treated as one component and easily mounted on the wireless device. Note here that a method of attaching each element to holding portion 23 may include a method of adhesively fixing each element to the surface of holding portion 23 with an adhesive agent, and a method of fixing antenna element 21 and parasitic element 22 by insert molding with insulating resin such as ABS. The fixing method is not particularly limited.

Since the antenna of the present invention has a configuration in which a variable reactance element and the like is not used, it has an advantageous effect that it can correspond to a small and thin size of a wireless device and reduce SAR easily. It is useful mainly for a wireless device for mobile communication and the like.

What is claimed is:

1. An antenna comprising:

a rectangular ground plane;

a feed point disposed in a vicinity of a corner of the ground plane;

an antenna element coupled to the feed point; and a parasitic element coupled to the ground plane, wherein a shortest length from the feed point to a distant narrow side of the ground plane and a shortest length from the feed point to a tip of the parasitic element via the ground plane have substantially same electrical length.

2. The antenna of claim 1, wherein an inductor is disposed between the ground plane and the parasitic element, or in a middle of the parasitic element, or at the tip of the parasitic element.

3. The antenna of claim 1, wherein a switch is disposed between the ground plane and the parasitic element.

4. The antenna of claim 1, further comprising a holding portion made of insulating resin, wherein the holding portion holds the antenna element and the parasitic element.

* * * * *